US006264719B1

(12) United States Patent
Zhang et al.

(10) Patent No.: US 6,264,719 B1
(45) Date of Patent: Jul. 24, 2001

(54) TITANIUM ALLOY BASED DISPERSION-STRENGTHENED COMPOSITES

(75) Inventors: Deliang Zhang, Hamilton; Martyn Rohan Newby, Auckland, both of (NZ)

(73) Assignee: Titanox Developments Limited, Auckland (NZ)

( * ) Notice: Subject to any disclaimer, the term of this patent is extended or adjusted under 35 U.S.C. 154(b) by 0 days.

(21) Appl. No.: 09/485,876

(22) PCT Filed: Aug. 19, 1998

(86) PCT No.: PCT/NZ98/00124

§ 371 Date: Feb. 16, 2000

§ 102(e) Date: Feb. 16, 2000

(87) PCT Pub. No.: WO99/09227

PCT Pub. Date: Feb. 25, 1999

(30) Foreign Application Priority Data

Aug. 19, 1997 (NZ) ..... 328571

(51) Int. Cl.[7] ..... B22F 1/00

(52) U.S. Cl. ..... 75/252; 75/352; 75/354; 75/369; 75/614

(58) Field of Search ..... 75/351, 352, 232, 75/235, 369, 614, 354, 252; 419/31, 33

(56) References Cited

U.S. PATENT DOCUMENTS

| | | | | |
|---|---|---|---|---|
| 4,619,699 | | 10/1986 | Petkovic-Luton et al. | 75/252 |
| 4,647,304 | * | 3/1987 | Petkovic-Luton et al. . | |
| 5,145,513 | * | 9/1992 | Matteazzi et al. | 75/255 |
| 5,328,501 | | 7/1994 | McCormick et al. | 75/352 |

FOREIGN PATENT DOCUMENTS

| | | |
|---|---|---|
| 02839W/02 | 7/1974 | (JP) . |
| 55-145102 | 11/1980 | (JP) . |
| 55-145135 | 11/1980 | (JP) . |
| 62-287027 | 12/1987 | (JP) . |
| 08193202 | 7/1996 | (JP) . |
| WO97/07917 | 3/1997 | (WO) . |

* cited by examiner

*Primary Examiner*—Ngoclan Mai
(74) *Attorney, Agent, or Firm*—Andrus, Sceales, Starke & Sawall, LLP

(57) ABSTRACT

Titanium based metal matrix composites reinforced with ceramic particulate are well known, based on a blend of titanium alloy powders with ceramic powders, e.g., aluminum oxide powders, utilizing a low energy ball milling process, followed by cold compacting and sintering to produce an appropriate composite. This prior art process is disadvantaged from the point of view that there are virtually no particles in the blend below the micrometer size range, which lack has a deleterious effect on the subsequent processing of the composite. This problem has been overcome by utilizing dry high energy intensive milling in the process, which has the effect of providing the necessary number of small particles below the micrometer size range as well as enhancing the reactivity of different particles with one another. In order to produce a titanium base alloy alumina metal matrix composite, titanium dioxide powder is blended with aluminum powder and subjected to dry high energy intensive milling until the separate particle phases achieve a size of 500 nanometers maximum. The intermediate powder product is then heated to form the titanium alloy/amumina metal matrix composite in which the ceramic particles have an average diameter of no more than 3 $\mu$, and the oxide consists of more than 10% and less than 60% by volume fraction of the total composite. The composites have extensive application to tough and strong engineering alloys.

35 Claims, 1 Drawing Sheet

TITANIUM ALLOY BASED DISPERSION-STRENGTHENED COMPOSITES

TECHNICAL FIELD

The present invention is directed to the preparation of a metal matrix composite reinforced with fine oxide particulate, and in particular a titanium alloy/alumina composite, and to a method of manufacture of such composites

BACKGROUND ART

The use of composite materials formed from fine fragments of desired materials is well known. The uses of these materials are known, though new applications are continually being found. However, the technology is relatively new and there are significant gaps in the prior art.

For instance, while many composite blends are known, many areas still remain to be explored and experimented with. Similarly, the techniques and methods of preparing composites and their pre-cursors are also incomplete, despite being relatively well established in some areas. Consequently, one object of the present invention is to extend the range of knowledge within this field, as well as attempting to increase the number of choices to users of the technology.

Metal Matrix Composites (MMCs) are composites of a tough conventional engineering alloy and a high strength second phase material, which may be an oxide, nitride, carbide or intermetallic. Oxide Dispersion Strengthened (ODS) alloys come at one end of the spectrum of MMCs. These are composites of a tough engineering alloy and a fine dispersion of an oxide. Typically, in order to obtain the required dispersion, there must be no more than 10% volume fraction of the oxide second phase, which may have a size of 10's of nm. At the other end of the MMC spectrum are the CERMETS in which the "second phase" exceeds 50% of the volume fraction, i.e. the oxide, carbide, nitride or intermetallic, in fact, forms the primary phase and the metal is the secondary phase.

Titanium alloy metal matrix composites reinforced with ceramic particulate are known, though traditionally these are usually produced by using conventional and known powder metallurgy techniques. In the known powder metallurgy routes, titanium alloy powder is blended with ceramic powders such as aluminium oxide powders. This blending is usually performed using a low energy ball milling process. The powder mixture is then cold compacted and sintered to produce bulk titanium alloy matrix composite.

However there are several disadvantages associated with the prior art. Firstly, it is a requirement that the titanium or titanium alloy powders are prepared according to a separate and known method. This can be relatively expensive and must be performed independently of the composite forming process. In contrast, ceramic powders are readily available so this does not represent a problem for the prior art. However, the range of available particle sizes of the ceramic powders does represent a problem. Typically, economic manufacturing processes of the ceramic powders is limited in that the smallest readily available powders are in the micrometer size range. While this is adequate for most composites, it is now recognised that smaller sized ceramic particles, or proportions of smaller sized ceramic particles, can improve the physical and mechanical characteristics of the composite product. By way of example, this is now well known in concrete technology which uses exceptionally finely sized silica fume particles to increase the overall strength and durability of the resulting cement/concrete matrix.

U.S. Pat. No. 5,328,501 (McCormick) discloses a process for the production of metal products by subjecting a mixture of one or more reducible metal compound with one or more reducing agent to mechanical activation. The products produced are metals, alloys or ceramic materials which this specification states may be produced as ultra-fine particles having a grain size of one micron or less. A variety of specific reactions are given by way of example, but in all cases, the method is dependent on the mechanical process producing the required reduction reaction. Furthermore, the patent is not directed towards the production of metal matrix composites reinforced with fine ceramic particulate.

There is no disclosure of titanium/alumina composites, nor of any methods for producing such composites.

There are some significant limitations in the prior art which increases the expense of producing composite materials, and which also limits the physical and mechanical characteristics of the composite product.

It is a further object of the present invention to address the foregoing problems or at least to provide the public with a useful choice.

DISCLOSURE OF INVENTION

According to one aspect of the present invention, there is provided a method of producing a metal matrix composite including high energy milling of a mixture of at least one metal oxide with at least one metal reducing agent in an inert environment to produce an intermediate powder product substantially each particle of which includes a fine mixture of the metal oxide(s) and the reducing metal(s) phases, and heating the intermediate powder product to form the metal matrix composite substantially each particle of which includes an alloy matrix of the metal(s) resulting from reduction of the metal oxide(s) reinforced with fine metal oxide particles resulting from oxidation of the metal reducing agent(s).

According to a further aspect of the present invention, there is provided a method of producing a titanium alloy/alumina metal matrix composite from titanium oxide and aluminium including high energy milling of a mixture of titanium oxide with aluminium in an inert environment to produce an intermediate powder product substantially each particle of which includes a fine mixture of titanium oxide and aluminium phases, and heating the intermediate powder product to form the titanium alloy/alumina metal matrix composite substantially each particle of which includes titanium alloy matrix reinforced with fine alumina particles.

The invention also provides for metal matrix composites and, in particular, titanium/alumina metal matrix composites produced in accordance with these methods, and also for consolidated products formed from such composites.

According to a further aspect of the invention, there is provided a metal matrix composite including a first phase metal or metal alloy and a second phase metal oxide in fine particulate form, the particles having an average diameter of no more than 3 $\mu$m, and the metal oxide comprising more than 10% and less than 60% volume fraction of the composite.

Other aspects of the invention may become apparent from the following description which is given by way of example only.

DETAILED DESCRIPTION OF INVENTION

Figure 1:
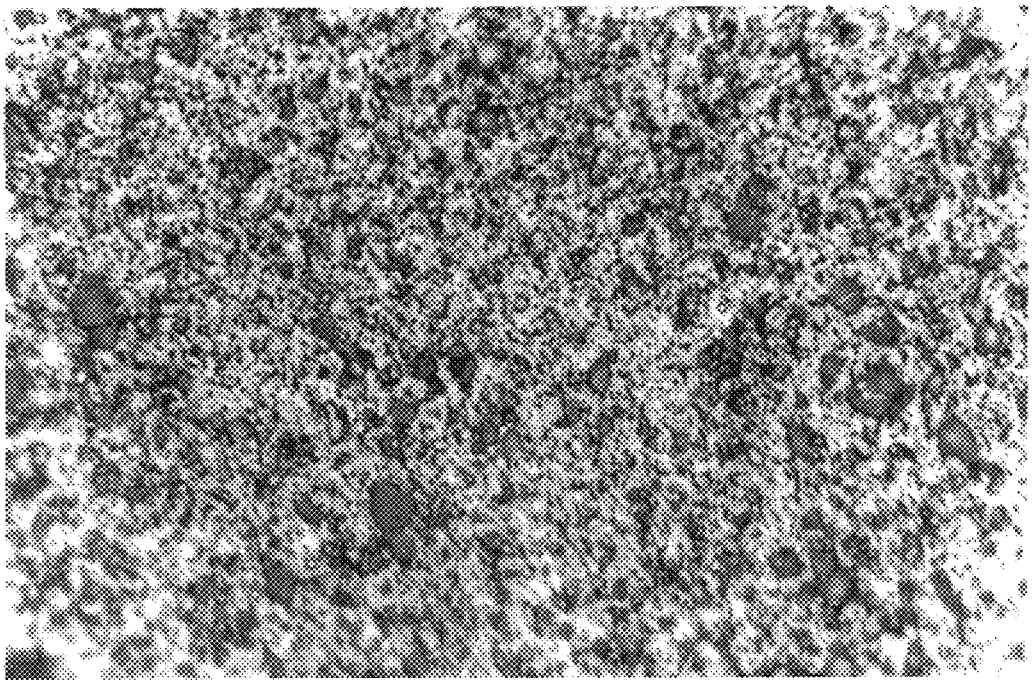
FIG. 1 is an optical micrograph showing the microstructure of each particle of the intermediate powder produced by high energy ball milling of TiO2/Al powder mixture for 8 hours. The white phase is Al and the dark phase is TiO2. (Magnification 1500×).

In the following description the invention is described in relation to a process for the manufacture of a titanium alloy/alumina metal matrix composite. However, it should be appreciated that the invention is more broadly directed towards a particular method of manufacturing metal matrix composites using high energy milling and subsequent heat treatment, and the invention is not limited to composites of titanium alloy and aluminium oxide.

The process of the invention can broadly be sub-divided into two steps. In the first step, the milling operation, powders of the metal oxide (for example $TiO_2$) and a metal reducing agent (for example aluminium) are together subjected to high energy milling in order to produce a particulate material in which each particle comprises a mixture of very fine phases of the metal oxide and the metal reducing agent, preferably the phases have a size of no more than 500 nanometers. The second principle step involves heating this intermediate powder product to produce a reduction reaction and phase change resulting in a metal matrix composite in which each particle comprises a mixture of very fine phases of the reduced metal alloy (e.g. titanium or titanium/aluminium alloy) and an oxide or oxides of the reducing metal (e.g. alumina). In this final composite the oxide phases may have sizes in the range 20 nanometers to 3 microns.

With the selected reactants, and under the conditions prescribed, the high energy milling process produces the required particle characteristics with very little or no substantial reduction. With the mix of very fine phases in the particles of the intermediate powder, the reduction that occurs during heating results in a composite with beneficial physical and mechanical characteristics.

With reference to the production of a titanium alloy/alumina composite, the overall process involves the production of a composite powder consisting of titanium metal, or a titanium alloy (which is intended to include titanium metal in its purest form as well as specific alloys) and aluminium oxide. Typically this involves the reaction of titanium dioxide with aluminium metal in the reaction process:

$$3TiO_2+4Al \rightarrow 2Al_2O_3+3Ti$$

If necessary, the oxides of other metals (such as vanadium) may be included though typically this is in small or trace amounts. The levels are at the user's discretion and will depend upon the type of alloy matrix of the material which they intend to produce, or the level of doping required in the final matrix. Typically, however, the levels of other metal oxides will be kept to substantially 8% or lower (by weight).

Further, it has been found in initial trials by the applicant that high purity reactants, such as often prescribed for composite manufacture, are not necessarily required. High grade ores of titanium (i.e. rutile) may be sufficiently pure to produce acceptable product characteristics. As a general guide, purity levels of substantially 98.5% or greater (by weight) for all of the reactants is sufficient. In some applications, lower purities may be acceptable, though it is envisaged that for most applications the purity levels will be kept to substantially 95% or greater (by weight). User's discretion can be applied, for in some instances certain impurities may be acceptable in the resulting product.

It is also contemplated that the process to produce a titanium/alumina composite may commence with reduction of ilmenite with aluminium as a precursor step.

The $TiO_2$ and aluminium components are reacted, not in the method of a typical thermite process, but rather using a combination of high energy milling apparatus and thermal treatment.

In one example, the milling may involve using high energy ball milling apparatus. The energy of the balls should be sufficient to deform, fracture, and cold weld the particles of the charge powders.

While the conditions of the milling process can be varied to achieve the desired result, typically the balls will be of a suitable material such as stainless steel and will be typically of a diameter of substantially 5–30 mm inclusive. Balls outside of this range may be used. A combination of balls of different sizes may also be used.

It has been found that a weight ratio between the balls and the powders which is substantially within the range 4:1–10:1 (by weight, inclusive) is preferred though once again weight ratios outside of this range may be chosen at user discretion.

Whilst specific reference is made to the use of high energy ball milling apparatus, it is not intended that the invention be restricted to simply this type of milling, although the apparatus must involve a high energy system capable of providing energy sufficient to deform, fracture and cold weld particles. Other apparatus capable of providing the required conditions are also contemplated and will be understood by persons skilled in the art. It is also considered that a split discus-type mill apparatus may be appropriate. Such apparatus is described in WO 98/17392 (Devereuex), the specification and drawings of which are incorporated herein by reference.

Preferably the milling process is performed under an atmosphere inert to the components. Preferably this is a noble gas as titanium oxides are reactive to nitrogen under suitable conditions. A mixture of various inert gases may also be used, with the preferred gas being argon.

The proportion of titanium oxide and aluminium is usually chosen so that at least the normal stoichiometric ratios are achieved. If, for user requirements, a percentage of included metal oxides is meant to remain, then the proportion of aluminium may be dropped. Similarly, it may be desirable to have as one of the products of the process, an impacted Ti—Al alloy, in which case the proportion of aluminium metal in the reactant mix will be increased. In practice, it has been found that a weight ratio between titanium oxide and aluminium powders in the range 1.8:1—2.3:1 (inclusive) is an acceptable range for most applications.

The components are placed within the milling apparatus and the process is continued until a powder having the desired particle characteristics is attained. Normally, it is anticipated that the given period Will be in the range of 2–10 hours, although this will depend upon the actual parameters of the system and choices made by the user. Typically, at the end of the milling process there will be a blended powder comprising fine fragments including a mixture of fine phases, mainly $TiO_2$ and Al, with substantially a size of less than 500 nanometers.

The intermediate product is then subjected to thermal treatment under an inert atmosphere. Preferably this comprises treatment at a temperature not exceeding 750° C., for a period exceeding 30 minutes. Preferably the temperature is maintained at around 700±50° C. for a period of up to 4 hours inclusive. Again these parameters may be altered according to user requirements and need. However, the selected temperature is important for producing a final product with optimal characteristics. Too high a temperature will inhibit the reducing potential of the aluminium. On the other hand, the higher the temperature the greater the titanium aluminide ($Ti_3Al$) content, and titanium aluminide may add important strength characteristics to the final product.

Typically, after the thermal treatment, each particle of the powder consists of nanometer-sized alumina ($Al_2O_3$) particles embedded in a matrix of titanium alloy; although the alumina particle average size may range from about 20 nm to 3 $\mu$m. Such a composite may be referred to as a fine oxide metal matrix composite A number of additional steps may be employed in the process of the present invention to further modify the characteristics and components of the metal matrix composite.

In particular, the volume fraction of alumina may be reduced (from about 60% to 40% or less) by pre-reduction of the titanium oxide with hydrogen at a temperature of 700° C. or greater. A preferred temperature is about 900° C. This pretreatment step results in a powder which includes a number of daughter oxides with lower oxygen content, titanium hydride and titanium phases. This is a way of controlling the volume fraction of alumina in the final composite.

In addition, or alternatively, the alumina volume fraction in the final product may be reduced by adding titanium powder to the mixture of titanium oxide and aluminium.

By increasing the quantity of aluminium in the initial mixture of reactants to 20% or more above the stoichiometric ratio for the reaction $3TiO_2+4Al \rightarrow 2Al_2O_3+3Ti$ a higher titanium aluminide ($Ti_3Al$) content may be achieved in the final composite. The higher the proportion of different titanium alloys in the final composite the lower the volume fraction of alumina and the smaller the size of alumina particles.

With those additional steps the alumina content of the titanium/alumina metal matrix composite can be reduced to below 60% volume fraction and preferably to the range 20% to 30% volume fraction of the composite, and the alumina particles tend to be of a smaller size.

The heat-treated titanium/alumina metal matrix composite may be returned to the mill one or more times to refine the shape of particle and further reduce the size of particle. A more regular-shaped particle provides for preferred characteristics in the final product.

The preferred metal matrix composite produced by a process of the present invention has an average particle size for the oxide particles (or second phase) in the range 20 nm to 3 $\mu$m, and an average composite particle size not greater than 100 $\mu$m.

The various steps of the preferred method of the present invention, as outlined above, may be carried out as distinct sub-processes in separate apparatus, for example, pre-reduction with hydrogen may be performed in a separate furnace, with high energy milling carried out in the mill, and subsequent heat treatment or "annealing" in the same or a different furnace. Alternatively, and with appropriate mill apparatus, the whole operation may be conducted in the mill.

Solid composite articles may be formed from the composite. Typically the powder is consolidated using known techniques. Quite simply this may comprise the use of routine metallurgy processes, such as cold compacting the powder under an inert atmosphere. It should be appreciated that other techniques for forming composite articles from blended materials may also be employed.

Some general comments about the present invention include the fact that titanium metals or alloys prepared by separate processes are not essential; high grade ores comprising oxides of titanium or other metals may be employed. This not only avoids separate preparation steps, but also the purification steps often associated with the other known manufacturing processes.

Further the average size of the oxide particles in the composite material is typically much finer than can be attained using most conventional prior art techniques. In the prior art, in order to attain the fine oxide particle sizes of the present invention, it will generally be necessary to further process the reactants prior to their use in forming a composite. With such a small size of reinforcement particles, the titanium alloy composites of the invention potentially possess higher fracture toughness than conventional composites.

As a comparison, the prior art prepares titanium alloy metal matrix composites by conventional powder metallurgy routes. In this route, preprepared titanium alloy powder is blended with ceramic powder such as aluminium oxide powders using a low energy ball milling process. The powder mixture is then cold compacted and sintered to produce bulk titanium alloy matrix composite materials. One limitation of the prior art method is that the average size of the ceramic particles in the materials prepared this way is normally in the micrometer size range, which is considerably larger than what is attainable according to the present invention.

The invention is further described with reference to specific examples, which should not be construed to limit the scope of the invention.

EXAMPLE 1

A ball milling apparatus is used in which the impact energy of the balls is sufficient to deform, fracture and cold weld the particles of the charge powders. The charge powders, titanium oxide and aluminium powders, and the balls (e.g. stainless steel balls) with a diameter of 5–30 mm are placed in a hardened steel container which is sealed under an inert atmosphere (normally argon). The total weight ratio between the balls and the powders is in the range of 4:1–10:1. The weight ratio between the titanium oxide and aluminium powders is approximately 2:1

Some excess amount of starting aluminium powder may be needed to adjust the composition of the titanium alloy in the final product. The sealed container is placed in a commercially available apparatus which facilitates high energy ball milling. Through high energy ball milling for a given period of time in the range of 2–10 hours, a new type of powder will form. Each particle of the new powder will be a composite of fine fragments.

The raw materials of the process are economical titanium dioxide powder (rutile, $TiO_2$) with purity not lower than 98.5% in weight, and aluminium powder with purity not lower than 98.5% in weight. The average particle size of the titanium oxide and aluminium powders is not larger than 300 $\mu$m. The impurities will stay in the final materials, but the detrimental effects (if there are any) on the properties will be controlled through adjusting powder processing parameters.

Raw materials with a high percentage of impurity might be used, but the consequence is that the properties of the final materials are compromised.

Vanadium pentoxide powder with a purity not lower than 98.5% can be included in the starting materials. The vanadium oxide is reduced by the aluminium through the process, and the metallic vanadium will go into the titanium alloy matrix of the final composites to improve the mechanical properties of the material. The percentage of the vanadium pentoxide in the starting powder mixture is in the range of 0–8 wt % (percentage by weight). The average particle size of the vanadium pentoxide is not larger than 300 $\mu$m. An example of the raw materials is:

60–67 wt % Titanium oxide powder (rutile, average particle size <300 $\mu$m)

31–35 wt % Aluminium powder (average particle size <300 $\mu$m)

0–8 wt % Vanadium pentoxide (average particle size <300 $\mu$m).

As described above, the product of this high energy ball milling process is a type of homogeneous composite powder each particle of which consists of fine fragments of mainly titanium oxide and aluminium and a small percentage of other oxides or phases. The average particle size is not larger than 100 $\mu$m. The shape of the particles is irregular.

The ball milled powder is then treated thermally under an inert atmosphere at a temperature around 700° C. for a given period of time in the range of 1–5 hours. After this thermal treatment, each particle of the powder consists of mainly nanometer sized $Al_2O_3$ particles embedded in a matrix of titanium alloy.

Bulk pieces or shaped components of composite materials may be produced by consolidating the processed powder materials using a routine powder metallurgy process. The powder metallurgy process may involve cold compacting the powder and subsequent sintering of the powder compact under an inert atmosphere.

EXAMPLE 2

A mixture of titanium oxide ($TiO_2$) and aluminium (Al) powders with $TiO_2$/Al weight ratio of 1.85:1 was added in a hardened steel container. The titanium oxide/aluminium weight ratio was controlled in such a way that the amount of aluminium was 20% in excess of the amount of aluminium required to fully reduce the titanium oxide. A number of steel balls were added to the charge in the container. The size of the balls was 10 mm in diameter, and the ball/powder weight ratio was 4.25:1.

The container containing the charge was sealed under an argon atmosphere and then put on a ball mill apparatus to facilitate a milling process in which the impact energy of the balls was sufficient to deform, fracture and cold weld the particles of the charged powders. After the powder charge had been milled in this way for 8 hours, an intermediate powder product had been produced. Substantially each particle of the powder included a mixture of titanium oxide and aluminium phases with a size less than 500 nm, as shown in FIG. 1.

Figure 2:
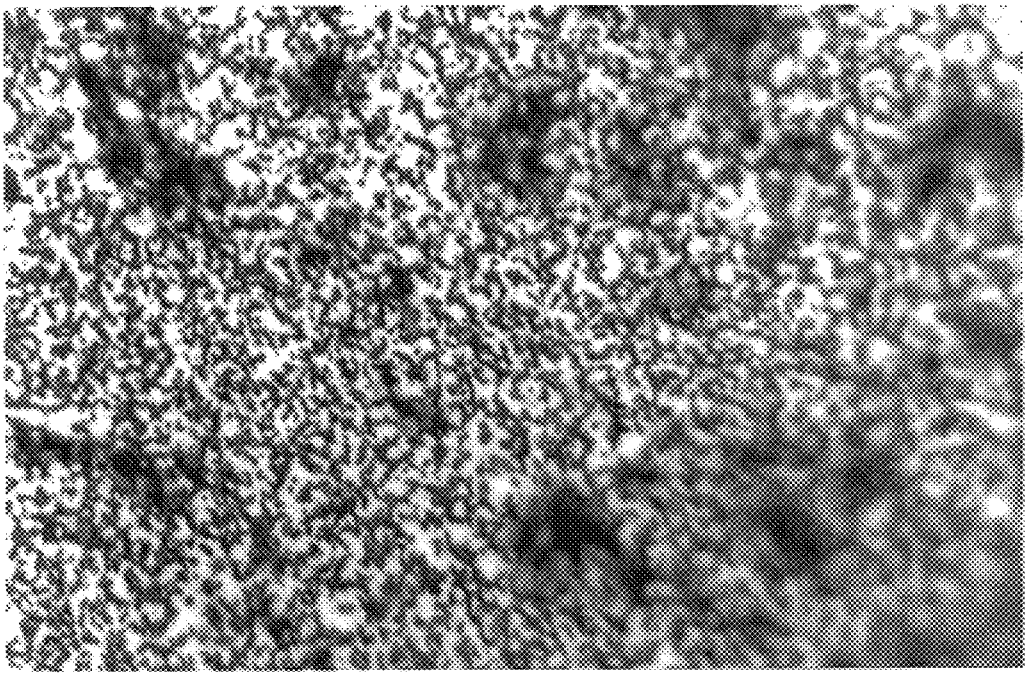
FIG. 2 is an optical micrograph showing the microstructure of each particle of the powder produced after heat treating the intermediate powder product for 4 hours at 700° C. The white phase is titanium alloy and the dark phase is alumina. (Magnification 1500×).

The intermediate powder product from the ball milling process was then heat treated at a temperature of 700° C. for 4 hours under an argon atmosphere. Heat treatment resulted in a powder of titanium alloy matrix composite reinforced by alumina particles with an average particle size in the range of 100 nm–3 $\mu$m, as shown in FIG. 2. Due to the excessive amount of aluminium, the matrix was mainly $Ti_3Al$ phase. The volume fraction of alumina particles in the composite was approximately 57%.

EXAMPLE 3

The titanium oxide ($TiO_2$) powder was heat treated in a furnace under a flow hydrogen atmosphere at 900° C. for 4 hours. Through this pre-reduction step, the $TiO_2$ was partially reduced to a mixture of $Ti_7O_{13}$, TiO and other titanium oxides with various oxygen contents. In this way, the total oxygen content in the titanium oxide powder was reduced to a lower level.

A mixture of the hydrogen pre-treated titanium oxide powder and aluminium powder was added in a steel container together with a number of steel balls. The weight ratio between titanium oxide and aluminium was controlled in such a way that the amount of aluminium was sufficient to fully reduce the partially reduced titanium oxides. The ball/powder weight ratio was in the range of 4:1–10:1 and the size of the balls was in the range of 5–30 mm. The container was sealed under an argon atmosphere and put on a ball mill apparatus to facilitate a milling process in which the impact energy of the balls was sufficient to deform, fracture and cold weld the particles of the charged powders. After the powder charge had been milled in this way for a time in the range of 2–10 hours, an intermediate powder product had been produced. Substantially each particle of the powder included a mixture of titanium oxide and aluminium phases with a size less than 500 nm.

The intermediate powder product from the ball milling process was heat treated at a temperature of 700° C. for 4 hours under an argon atmosphere. Heat treatment resulted in a powder of titanium alloy matrix composite reinforced by alumina particles with an average particle size in the range of 20 nm–3 $\mu$m. The volume fraction of the alumina particles in the composite was in the range of 20–50%.

Aspects of the present invention have been described by way of example only and it should be appreciated that modifications and additions may be made thereto without departing from the scope thereof.

What is claimed is:

1. A method of producing a metal matrix composite including high energy milling of a mixture of at least one metal oxide with at least one metal reducing agent in an inert environment to produce an intermediate powder product substantially each particle of which includes a fine mixture of the metal oxide(s) and the reducing metal(s) phases, and heating the intermediate powder product to form the metal matrix composite substantially each particle of which includes an alloy matrix of the metal(s) resulting from reduction of the metal oxide(s) reinforced with fine metal oxide particles resulting from oxidation of the metal reducing agent(s).

2. A method of according to claim 1 further including a pre-reduction step including exposing the at least one metal oxide to hydrogen gas at a temperature above 700° C. prior to introduction of the at least one metal reducing agent.

3. A method according to claim 1 wherein substantially each particle of the intermediate powder product includes a fine mixture of the metal oxide(s) and the reducing metal(s) phases with a size of 500 nm or less.

4. A method according to claim 1 wherein the metal matrix composite includes fine reducing metal oxide particles having an average diameter within the range of substantially 20 nanometers to 3 microns inclusive.

5. A method according to claim 1 wherein the high energy milling is in a high energy ball mill.

6. A method of producing a titanium alloy/alumina metal matrix composite from titanium oxide and aluminium including high energy milling of a mixture of titanium oxide with aluminium in an inert environment to produce an intermediate powder product substantially each particle of which includes a fine mixture of titanium oxide and aluminium phases, and heating the intermediate powder product to form the titanium alloy/alumina metal matrix composite substantially each particle of which includes titanium alloy matrix reinforced with fine alumina particles.

7. A method according to claim 6 wherein in the heating step the intermediate powder product is heated to a temperature not exceeding 750° C. for a period exceeding 30 minutes.

8. A method according to claim 7 wherein the intermediate powder product is heated to a temperature of substantially 700+/−50° C. for a period of substantially 1 to 6 hours inclusive.

9. A method according to claim 6 further including a pre-reduction step including exposing the titanium oxide to hydrogen gas at a temperature above 700° C. prior to the introduction of aluminium.

10. A method according to claim 6 wherein substantially each particle of the intermediate powder product includes a fine mixture of titanium oxide and alumina phases with a size of 500 nanometers or less.

11. A method according to claim 6 wherein the fine alumina particles have an average diameter within the range of substantially 20 nanometers to 3 microns inclusive.

12. A method according to claim 6 wherein the high energy milling is in a high energy ball mill.

13. A method according to claim 12 wherein the balls of the ball mill have a diameter between 5 and 30 mm inclusive.

14. A method according to claim 13 wherein the total weight ratio between the balls and components being milled (balls:components) is in the range 4:1 to 10:1 inclusive.

15. A method according to claim 6 wherein die high energy milling is provided by split-discus milling.

16. A method according to claim 6 wherein the inert atmosphere includes one or more of the noble gases.

17. A method according to claim 6 wherein the temperature and duration of heating during the heating step is adjusted to optimise titanium aluminide content.

18. A method according to claim 6 wherein the titanium oxide is an ore of titanium.

19. A method according to claim 6 wherein the purity of the titanium oxide is preferably 98.5% or greater (by weight).

20. A method according to claim 6 wherein the purity of the aluminium is 98.5% or greater (by weight).

21. A method according to claim 6 wherein the ratio between titanium oxide and aluminium in the following reaction is approximately stoichiometric:

$$3TiO_2+4Al \rightarrow 2Al_2O_3+3Ti.$$

22. A method according to claim 6 wherein the quantity of aluminum is substantially 20% higher than a stoichiometric ratio for the reaction:

$$3TiO_2+4Al \rightarrow 2Al_2O_3+3Ti.$$

23. A method according to claim 6 further including the step of returning the titanium alloy/alumina metal matrix composite for further high energy milling to refine the particle shape and/or size.

24. A method according to claim 6 wherein oxides of other metals are included with the titanium oxide.

25. A method according to claim 24 wherein there is 8% or less of oxides of other metals.

26. A method according to claim 25 wherein the other metal oxide or oxides includes another transition metal element.

27. A method according to claim 26 wherein the other transition metal element is vanadium.

28. A method according to claim 6 wherein the high energy milling and heating steps are conducted in a common environment.

29. A method according to claim 9 wherein the high energy milling, heating and pre-reduction steps are conducted in a common environment.

30. A metal matrix composite produced according to the method claim 1.

31. A titanium alloy/alumina metal matrix composite produced according to the method of claim 6.

32. A metal matrix composite including a first phase metal alloy and a second phase metal oxide in fine particulate form, the particles having an average diameter of no more than 3 $\mu$m, and the metal oxide comprising more than 10% and less than 60% volume fraction of the composite.

33. A metal matrix composite according to claim 32 wherein the metal oxide comprises 20 to 30% volume fraction of the composite.

34. A titanium alloy/alumina metal matrix composite substantially each particle of which includes titanium alloy matrix reinforced with fine alumina particles, the alumina particles comprising more than 10% and less than 60% volume fraction of the composite.

35. A titanium alloy/alumina metal matrix composite according to claim 34 in which the alumina particles have an average diameter of no more than 3 $\mu$m.

* * * * *

UNITED STATES PATENT AND TRADEMARK OFFICE
Certificate

Patent No. 6,264,719 B1 Patented: July 24, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Deliang Zhang, Hamilton, (NZ); Martyn Rohan Newby, Auckland, (NZ); and Danyang Ying, Hamilton, (NZ).

Signed and Sealed this Third Day of March 2009.

ROY KING
*Supervisory Patent Examiner*
Art Unit 1793